United States Patent [19]

Todd et al.

[11] Patent Number: 4,773,645

[45] Date of Patent: Sep. 27, 1988

[54] MULTISIZE BOWLING FINGER INSERT

[76] Inventors: Jack A. Todd, 5852 Serena St., Simi Valley, Calif. 93063; Thomas B. Hibler, 1260 Calle Las Trancas, Thousand Oaks, Calif. 91360

[21] Appl. No.: 43,438

[22] Filed: Apr. 28, 1987

[51] Int. Cl.[4] ..... A63B 43/02

[52] U.S. Cl. ..... 273/63 A; 273/63 B

[58] Field of Search ..... 273/63 A, 63 B, 63 R, 273/63 C, 63 D, 63 E, 63 F, 63 G

[56] References Cited

U.S. PATENT DOCUMENTS

| | | | |
|---|---|---|---|
| 2,453,036 | 11/1948 | Reitsma | 273/63 B |
| 2,859,039 | 11/1958 | Jerome | 273/63 A |
| 3,113,775 | 12/1963 | Taylor | 273/63 A |
| 3,383,109 | 5/1968 | Jankiewicz et al. | 273/63 B |
| 4,381,863 | 5/1983 | Norman | 273/63 A |
| 4,416,452 | 11/1983 | Heimbigner | 273/63 A |
| 4,623,149 | 11/1986 | Herman | 273/63 A |

*Primary Examiner*—George J. Marlo

*Attorney, Agent, or Firm*—Poms, Smith, Lande & Rose

[57] ABSTRACT

By using two different diameters at the two ends of each bowling ball finger hole insert or grip, the number of finger inserts required to be stocked is reduced from about ten to about five. At least two ribs are provided in each half of the insert, with the cross-section of the insert being substantially D-shaped where the ribs are located. The inserts are sufficiently flexible so that one edge of the insert may be displaced relative to the other edge so that the inserts are substantially flush with the surface of the bowling ball as the inserts are glued into place. The edges of the gripping ribs have sharp corners to insure good frictional engagement between the fingers and the inserts.

20 Claims, 2 Drawing Sheets

MULTISIZE BOWLING FINGER INSERT

FIELD OF THE INVENTION

This invention relates to bowling ball finger hole inserts or grips.

BACKGROUND OF THE INVENTION

In bowling, it is desirable to have the ball hook somewhat as it is rolling down the alley, as the bowling ball will then tend to knock down a greater number of pins as compared with a ball following a straight path. To make a ball hook, it is desirable to apply upward force or "lift" to the ball as it is being released, by initially withdrawing the thumb from the thumb hole, and completing the release of the ball using the two fingers.

Most good bowlers use finger inserts or grips in the finger holes to increase the friction between the fingers and the bowling ball during the critical instant as the ball is being released.

Now, in most bowling balls, the finger holes are 31/32 inch in diameter and about $1\frac{1}{8}$ or $1\frac{1}{4}$ inches deep. Finger inserts normally are available in about ten different sizes increasing in increments of one-thirty-second inch, in the inner diameter of the insert, from about 19/32 inch to about $\frac{7}{8}$ inch (28/32 inch). The demand for all of these different sizes, possibly for more than one brand of insert, means that bowling equipment shops must maintain an extensive inventory of inserts, and often do not buy sufficient quantities of any one insert from their suppliers to get a quantity discount.

It is further noted that at least certain types of inserts do not provide the finger gripping action or frictional engagement which would be desirable.

Accordingly, principal objects of the present invention are (1) to provide an insert having improved gripping engagement with the fingers, and (2) to combine two sizes of inserts in a single insert with accurate fit for each size, and without any adverse effects being noticeable to the user.

SUMMARY OF THE INVENTION

In accordance with a broad aspect of the invention, the foregoing objects are achieved by forming bowling ball finger inserts with opposite ends having different diameters, and at least two transverse ribs forming a D-shaped cross-sectional configuration in each end of the insert.

By this technique, the required stock of inserts for bowling supply shops may be reduced in half, and larger quantities of inserts may be purchased, thereby permitting quantity discounts in purchasing.

Other aspects and features of the invention include the following:

(1) The inserts are preferably somewhat flexible so that one side may be initially glued into the ball with the edge at the one side of the insert flush with the ball surface, and the other edge at the other side protruding slightly; and then after the first side is secured in place, the other side may have glue applied to it, and the insert is flexed or deformed slightly, so that the second edge is flush with the ball surface while the glue sets up. The foregoing arrangements mean that, in the unstressed state, the ends of the inserts are flat, and accommodate both left and right-handed bowlers.

(2) The transverse ridges preferably have relatively sharp edges, with transverse ribs being located at both of the outer lips of each insert.

(3) The inserts may come in five sizes, from the smallest inner diameters having inner diameters of 19/32 inch and $\frac{5}{8}$ inch, to the largest inner diameters of 27/32 inch and $\frac{7}{8}$ inch.

(4) The size numbers may be moulded on the inside of the inserts, on both ends thereof.

(5) The grips or inserts may be made of any suitable material, such as polyvinyl/chloride, or urethane, having adequate flexibility, as discussed hereinabove. The material preferably has a "Shore" hardness of between 45 and 50 on the "A" scale, but could have a hardness between about 40 and about 55, on this "Shore" hardness "A" scale.

Other objects, features and advantages of the invention will become apparent from a consideration of the following detailed description and the accompanying drawings.

DETAILED DESCRIPTION

Figure 1:
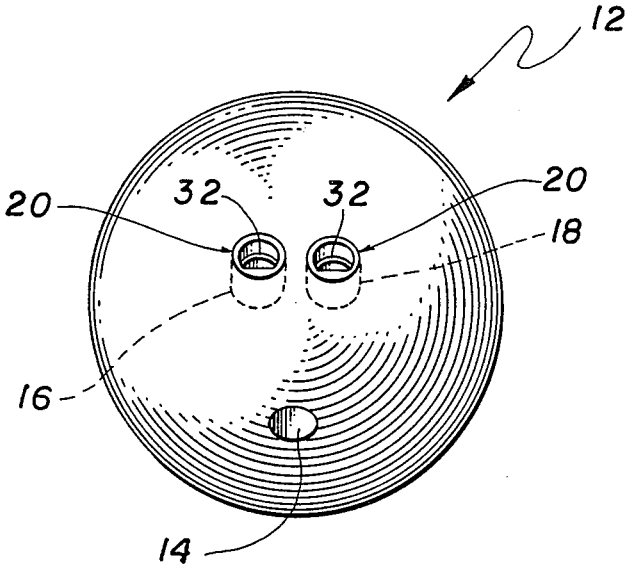
FIG. 1 shows inserts illustrating the principles of the present invention mounted in a bowling ball.

Referring more particularly to the drawings, FIG. 1 shows a bowling ball 12, with a thumb hole 14 and two finger holes 16 and 18, each including inserts 20 illustrating the principles of the present invention. The inserts 20 will be shown and described in greater detain in connection with the remaining figures of the drawings.

Figure 2:
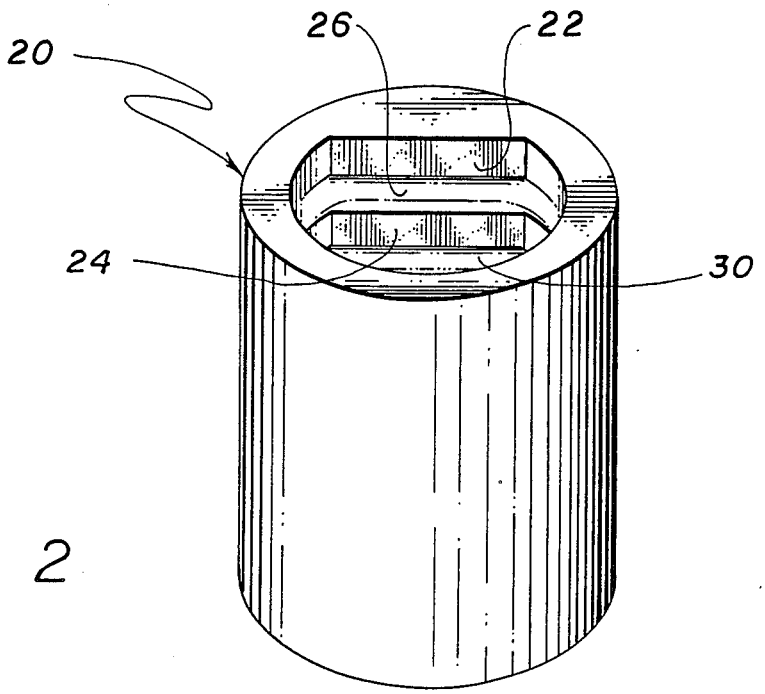
FIG. 2 is a perspective view of an insert illustrating the principles of the present invention.

FIG. 2 is a perspective view of an insert 20 illustrating the principles of the present invention. As shown in FIG. 2, the insert or grip 20 has an opening at its upper end which appears to be generally D-shaped, with the D-shaped configuration forming a first rib 22 at the very lip of the insert or grip 20, and with a second transverse rib 24 located within the grip and having a recess or space 26 between the two ribs. Toward the center of the entire unit is a raised portion 28, spaced from the second rib 24 by an additional recess 30. At the center of the raised portion 28 at the middle of the insert, is a line 32 representing a change in height of the raised portion 28. Thus, the upper portion of the insert 20 as shown in FIG. 2, has a larger diameter; and the lower portion, which is not visible in its entirety in FIG. 2, has a smaller diameter, and has its corresponding ribs located similarly to those shown at 22, 24 in FIG. 2, located somewhat closer to the center or the axis of the insert 20.

Figure 3:
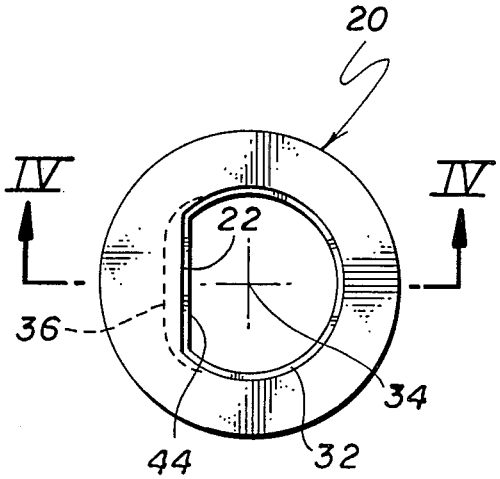
FIG. 3 is an end view of the bowling ball finger insert or grip of FIG. 2.

FIG. 3 is an end view of the insert 20 taken along the axis 34 of the unit. The outermost rib 22 is shown, and the dashed line 36 in FIG. 3 represents the bottom of the recesses 26 and 30, which are between the ribs.

Figure 4:
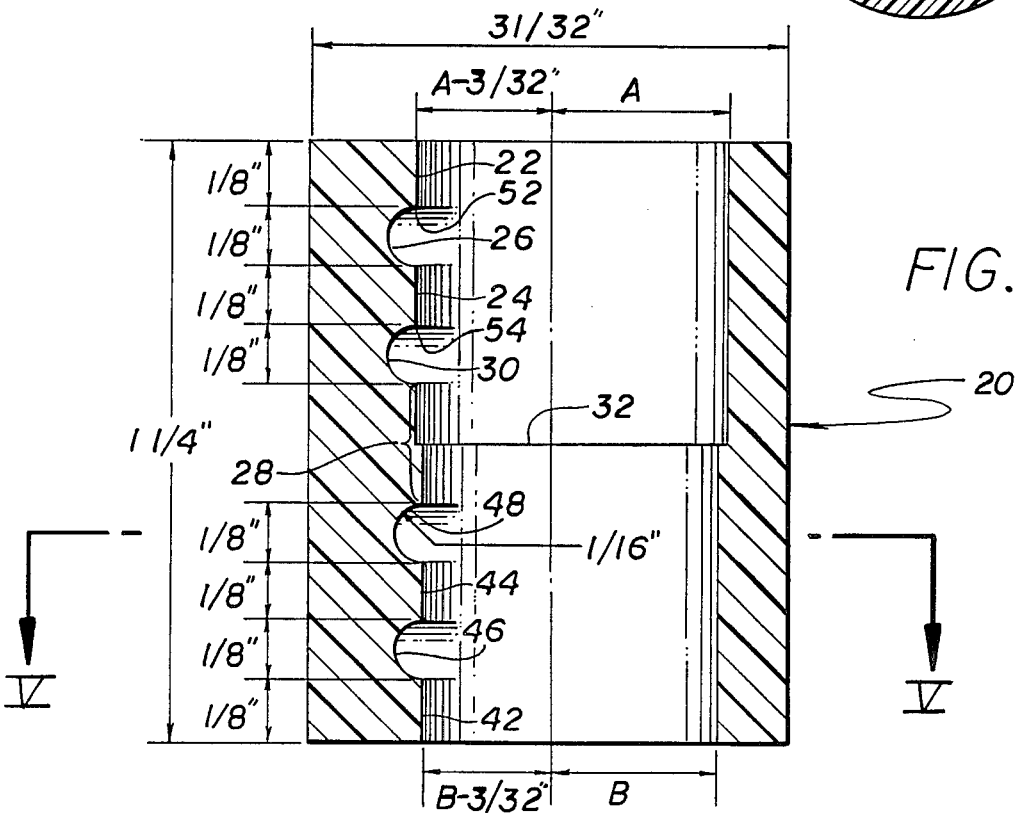
FIG. 4 is a cross-sectional view taken along lines IV—IV of FIG. 3.

FIG. 4 is a cross-sectional view taken along the plane indicated by lines IV—IV of FIG. 3. In FIG. 4, the ribs 22 and 24 are spaced apart by the recess 26. In addition, the central raised portion 28 is shown, spaced from rib 24 by recess 30. FIG. 4 also shows the dividing line 32 separating the larger upper portion of the insert or grip 20 from the lower section of the grip which has a reduced diameter grip portion. With reference to the lower portion of the grip 20, it includes the two ribs 42 and 44, and the recesses 46 and 48 between the two ribs 42 and 44, and between the rib 44 and the central raised portion 28.

Figure 5:
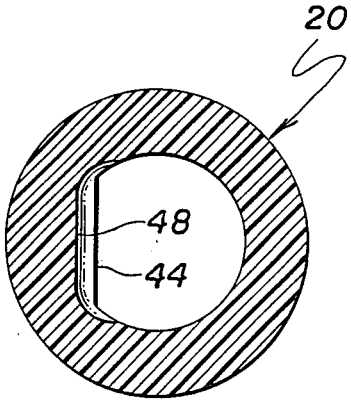
FIG. 5 is a cross-sectional view taken along lines V—V of FIG. 4.

For completeness, FIG. 5 is a cross-sectional view through the plane defined by lines V—V in FIG. 4. In FIG. 5, the rib 44 is visible, and the reference numeral 48 has a lead line which extends to the bottom of the recess.

Incidentally, it may be noted that the inner corners 52 and 54 on the ribs 22 and 24, respectively, are relatively sharp, to provide good gripping action on the fingertips as the bowling ball is released.

By way of completeness, reference is made to U.S. Pat. No. 950,838, patented Mar. 1, 1910; U.S. Pat. No. 4,623,149, patented Nov. 18, 1986. With regard to the Cavanaugh patent, it involves recesses which are made into the finger holes or the finger and thumb holes themselves, rather than inserts. In addition, the recesses appear to be rounded, rather than having sharp corners, and the openings are round rather than D-shaped. Concerning J. Herman, U.S. Pat. No. 4,623,149, it appears to have a D-shaped configuration, but does not appear to have successive ridges and grooves, with sharply defined edges, as disclosed in the present patent application. In addition, the two ends of the Herman grip or insert are both tapered, so that the insert may fit flush at the outer surface of the bowling ball for left, and right-hand bowlers. In addition, of course, the Herman insert is only of one size, as contrasted with the different sizes at the opposite ends of the insert of the present invention, with its attendant advantages, as discussed above.

In Table I set forth on the following page, the dimensions of five grips or inserts designated I through V are shown, with the dimensions for each insert or grip being given in terms of the "A" and "B" dimensions, as shown in FIG. 4 of the drawings. Many of the other dimensions as shown in FIG. 4 are the same for all grip or insert sizes. It may be noted in passing that the present invention is practical in part because of the reduction in diameter of the tips of the bowler's fingers as compared with the diameter of one's fingers where engagement with the two outer ribs occurs. Accordingly, there is no need for a constant diameter for the full depth of the insert.

TABLE I

| INSERT OR GRIP | INSERT SIZES | A | B |
|---|---|---|---|
| I | 1 and 2 | 5/16 | 19/64 |
| II | 3 and 4 | 11/32 | 21/64 |
| III | 5 and 6 | 3/8 | 23/64 |
| IV | 7 and 8 | 13/32 | 25/64 |
| V | 9 and 10 | 7/16 | 27/64 |

NOTE:
(1) Dimensions are given in inches.
(2) Dimensions "A" and "B" refer to A and B in FIG. 4 of the drawings.

In conclusion, it is to be understood that the specific embodiment as described hereinabove is illustrative of the principles of the invention. Thus, by way of example and not of limitation, the configuration using different size openings at the two ends of the insert could be employed with other gripping or rib configurations; and similarly, the sharply cornered ribs in the disclosed insert could be employed with inserts having only a single size throughout their length. Thus, although the indicated design is the preferred design, various changes and modifications are considered to be within the scope of the invention.

What is claimed is:

1. A bowling ball finger insert or grip having a different size radius on each end thereof, comprising:

a body portion having a substantially cylindrical outer surface, said body portion being sufficiently flexible to permit deformation in the axial direction of one side relative to the opposite side;

said body portion having a central aperture extending substantially parallel to the axis of said cylindrical outer surface, said central aperture being divided substantially into two halves, along a plane substantially perpendicular to said axis, with an upper half having a first predetermined radius, said first predetermined radius being in the range of from 19/64 inch to 27/64 inch, and a lower half having a second predetermined radius, differing slightly from said first radius; and at least two transverse ribs which are substantially straight across, in both the upper half and the lower half of said central aperture, said ribs being spaced from said central axis by a distance substantially equal to the radius of the aperture less 3/32 inch.

2. A set of five different bowling ball finger inserts or grips as defined in claim 1, wherein each said insert has an axial aperture with different radii of said aperture at opposite ends of said insert, and wherein each of said five inserts of said set has an aperture with radii which are different from those of each of the other four inserts of said set.

3. A bowling ball finger insert as defined in claim 1 wherein the ends of said insert, when the insert is in the unstressed state prior to mounting, are substantially flat and perpendicular to the axis of insert.

4. A bowling ball finger insert as defined in claim 1 wherein said ribs have sharp corners to increase gripping friction between the fingers and said insert.

5. A bowling ball finger insert as defined in claim 1 wherein said insert is slightly flexible or deformable, whereby one side thereof may be initially glued to a finger hole of a bowling ball, and later the insert may be flexed into a configuration where the outer end of the insert is flush with the surface of the bowling ball and the other side thereof glued in place.

6. A bowling ball finger insert as defined in claim 1 wherein said insert has a "Shore A scale" hardness in the range of substantially 45 to 50.

7. A bowling ball finger insert as defined in claim 1 wherein said insert has a "Shore A scale" hardness in the range of substantially 40 to 55.

8. A bowling ball finger insert or grip having a different size radius on each end thereof, comprising:

a body portion having a substantially cylindrical outer surface, said body portion being sufficiently flexible to permit deformation in the axial direction of one side relative to the opposite side; and said body portion having a central aperture extending substantially parallel to the axis of said cylindrical outer surface, said central aperture being divided substantially into two halves, along a plane substantially perpendicular to said axis, with an upper half having a first predetermined radius, said predetermined radius being in the range of from 19/64 inch to 27/64 inch, and a lower half having a second predetermined radius, differing significantly from said first radius.

9. A bowling ball finger insert as defined in claim 8 wherein said aperture is substantially D-shaped.

10. A bowling ball finger insert as defined in claim 8 wherein said aperture is provided with at least two transverse ribs adjacent each end of said insert and forming a chord extending across a portion of said aperture.

11. A set of five different bowling ball finger inserts or grips as defined in claim 8, wherein each said insert has an axial aperture with different radii of said aperture at opposite ends of said insert, and wherein each of said five inserts of said set has an aperture with radii which are different from those of each of the other four inserts of said set.

12. A bowling ball finger insert as defined in claim 8 wherein the ends of said insert, when the insert is in the unstressed state prior to mounting, are substantially flat and perpendicular to the axis of insert.

13. A bowling ball finger insert as defined in claim 10 wherein said ribs have sharp corners to increase gripping friction between the fingers and said insert.

14. A bowling finger insert as defined in claim 8 wherein said insert has a "Shore A scale" hardness in the range of substantially 40 to 55.

15. A bowling ball finger insert or grip comprising:

a body portion having a substantially cylindrical outer surface, said body portion being sufficiently flexible to permit deformation in the axial direction of one side relative to the opposite side;

said body portion having a central aperture extending substantially parallel to the axis of said cylindrical outer surface, said central aperture being divided substantially into two halves, along a plane substantially perpendicular to said axis, at least a pair transverse ribs which are substantially straight across, in both the upper half and the lower half of said central aperture, said upper pair of ribs being spaced from said central axis by a significantly different distance than the distance of said lower pair of ribs from said axis;

whereby said insert has two effective sizes depending on the orientation thereof.

16. A set of five different bowling ball finger inserts as defined in claim 15 wherein the distance from the ribs to the axis of the insert at each of the ten halves of said five inserts is different.

17. A bowling ball finger insert as defined in claim 15 wherein the ends of said insert, when the insert is in the unstressed state prior to mounting, are substantially flat and perpendicular to the axis of insert.

18. A bowling ball finger insert as defined in claim 15 wherein said ribs have sharp corners to increase gripping friction between the fingers and said insert.

19. A finger insert as defined in claim 15 wherein said insert has a "Shore A scale" hardness in the range of substantially 40 to 55.

20. A bowling ball finger insert as defined in claim 15 wherein said aperture is substantially D-shaped.

* * * * *